US006171071B1

(12) United States Patent
Tzeng et al.

(10) Patent No.: US 6,171,071 B1
(45) Date of Patent: Jan. 9, 2001

(54) WATER PUMP HAVING WATER COOLING DEVICE

(76) Inventors: Tsann Ruey Tzeng; Sheng Jong Tzeng, both of No. 35, Pin Yuan Li, Tong Shiau Town, Miau Li Hsien (TW)

( * ) Notice: Under 35 U.S.C. 154(b), the term of this patent shall be extended for 0 days.

(21) Appl. No.: 09/374,007

(22) Filed: Aug. 16, 1999

(30) Foreign Application Priority Data

Nov. 18, 1998 (TW) ..... 87219204

(51) Int. Cl.[7] ..... F04B 49/00

(52) U.S. Cl. ..... 417/279; 417/299; 417/307; 417/311; 417/440

(58) Field of Search ..... 417/279, 278, 417/299, 307, 311, 284, 440, 243, 297

(56) References Cited

U.S. PATENT DOCUMENTS 1,070,733 * 8/1913 Reavell ..... 417/252
2,342,001 * 2/1944 Magnuson ..... 60/54.6
2,665,552 * 1/1954 Deardorff ..... 60/52
2,700,339 * 1/1955 Schmitt ..... 103/42
4,008,012 * 2/1977 Page ..... 417/454
4,445,818 * 5/1984 Ohsaki et al. ..... 417/288

* cited by examiner

*Primary Examiner*—Timothy S. Thorpe
*Assistant Examiner*—Timothy P. Solak
(74) *Attorney, Agent, or Firm*—Charles E. Baxley

(57) ABSTRACT

A water pump includes a housing having a water inlet, a water outlet, an exit and a mouth. A circulating water passage couples the exit to the mouth of the housing. A pump may pump water from the exit to the mouth of the housing via the circulating water passage. The housing includes two ducts communicating with each other and communicating with the mouth, and the water inlet and the water outlet respectively. Two plugs are slidably disposed in the ducts for switching water to circulate through the exit and the circulating water passage when the water outlet is closed.

10 Claims, 6 Drawing Sheets

WATER PUMP HAVING WATER COOLING DEVICE

BACKGROUND OF THE INVENTION

1. Field of the Invention

The present invention relates to a water pump, and more particularly to a water pump having a water cooling device.

2. Description of the Prior Art

Typical water pumps are provided for pumping water to a reservoir or the like. However, the typical water pumps have no water cooling device for cooling the water pumps. In addition, when the valve in the reservoir is switched off, the water pump some times may still be energized and actuated such that the water pressure in the water pump or in the coupling pipes may be greatly increased and such that the coupling pipes and the other elements may be damaged.

The present invention has arisen to mitigate and/or obviate the afore-described disadvantages of the conventional water pumps.

SUMMARY OF THE INVENTION

The primary objective of the present invention is to provide a water pump including a pressure relieving device for relieving the pressure in the water passages when the water outlet is switched off and when the water pump is still actuated, and including a cooling device for cooling the water pump.

In accordance with one aspect of the invention, there is provided a water pump comprising a housing having a water inlet and a water outlet and having an exit and a mouth, a circulating water passage coupled between the exit and the mouth of the housing, means for pumping water from the exit to the mouth of the housing via the circulating water passage, and means for switching water to flow out of the water outlet when the water outlet is opened and to circulate through the exit and the circulating water passage when the water outlet is closed.

The circulating water passage includes a first coupler coupled to the exit of the housing, a first receptacle coupled between the first coupler and the mouth, a second coupler and a second receptacle secured together, a tube secured between the first and the second couplers, and a conduit coupled between the first and the second receptacles. A rod is slidably received between the first and the second couplers, and means for moving the rod in a reciprocating action to pump the water in the first and the second couplers to the first and the second receptacles respectively.

The moving means includes a casing, a shaft rotatably secured in the casing and having an eccentric pawl for engaging with and moving the rod, and a rotating means includes a gear provided on the shaft, and a motor having a pinion engaged with the gear to drive the shaft. The conduit extends through the casing for cooling a lubricating oil received in the casing.

The switching means includes a first duct and a second duct and a partition provided between the first duct and the second duct, the first duct includes a first portion communicating with the mouth and includes a second portion, the second duct includes a first interior portion communicating with the water inlet and includes a second interior portion communicating with the water outlet, the partition includes a first passage communicating the first portion of the first duct with the first interior portion of the second duct and includes a second passage communicating the second portion of the first duct with the second interior portion of the second duct, and means for blocking the first interior portion of the second duct when the water outlet is opened.

The switching means includes a separator gasket secured between the second and the first interior portions, a first valve seat provided between the water inlet and the first interior portion of the second duct, a first plug for engaging with the first valve seat, and means for biasing the first plug to engage with the first valve seat when the water outlet is closed. The switching means includes a second valve seat provided between the first and the second portions of the first duct, a second plug for engaging with the second valve seat, and means for biasing the second plug to engage with the second valve seat when the water outlet is closed.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
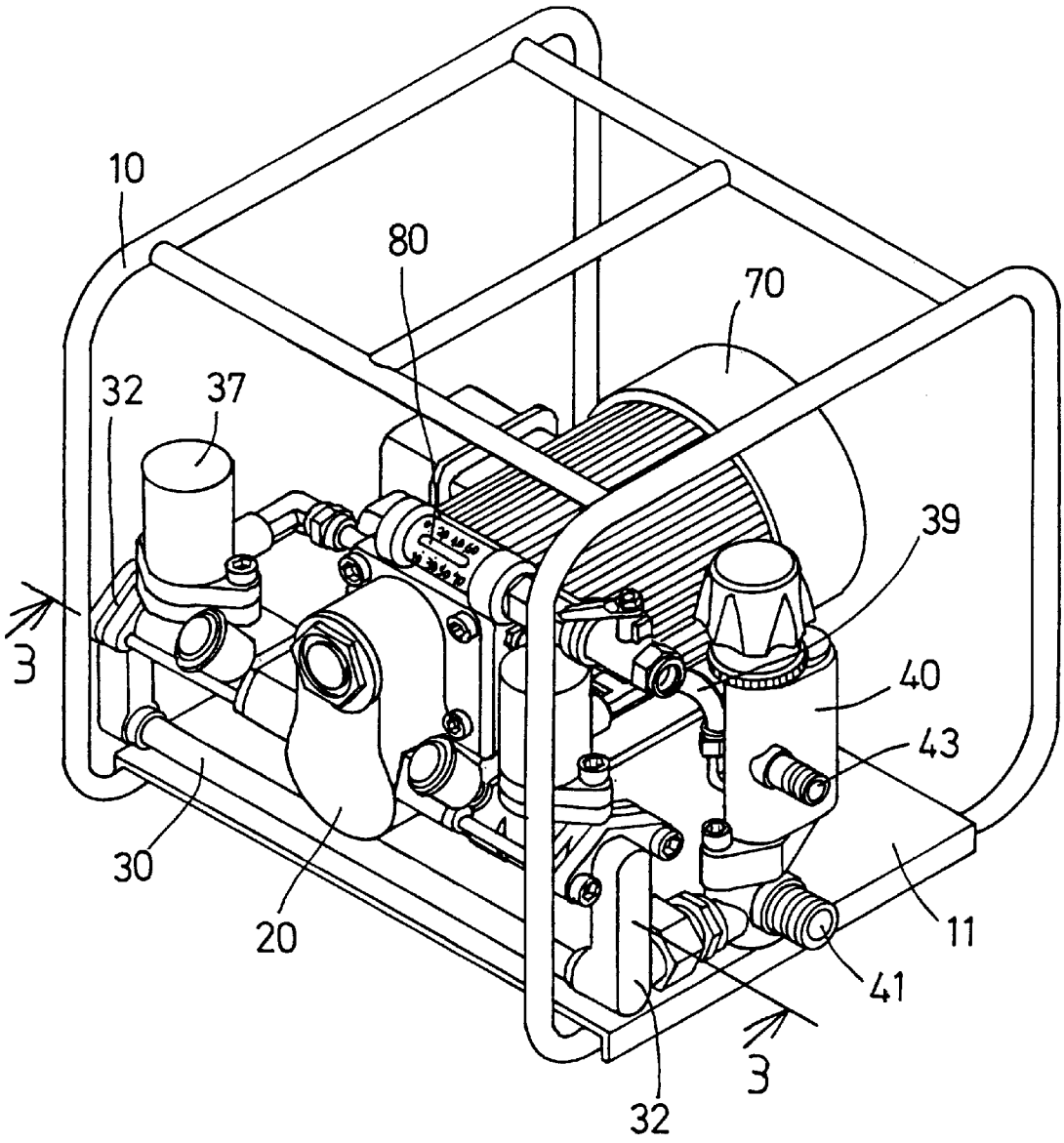
FIG. 1 is a perspective view of a water pump.
Figure 2:
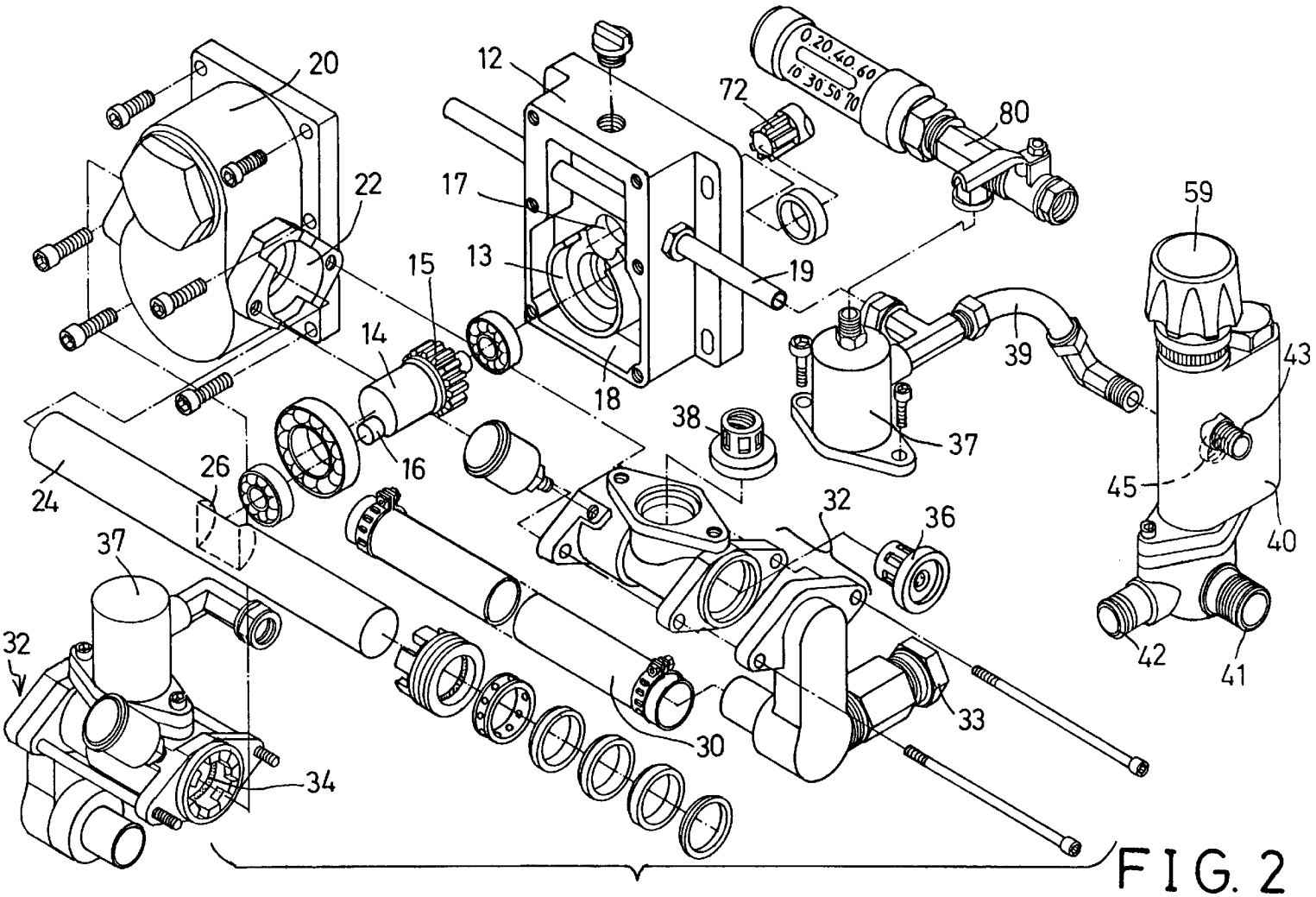
FIG. 2 is an exploded view of the water pump.
Figure 3:
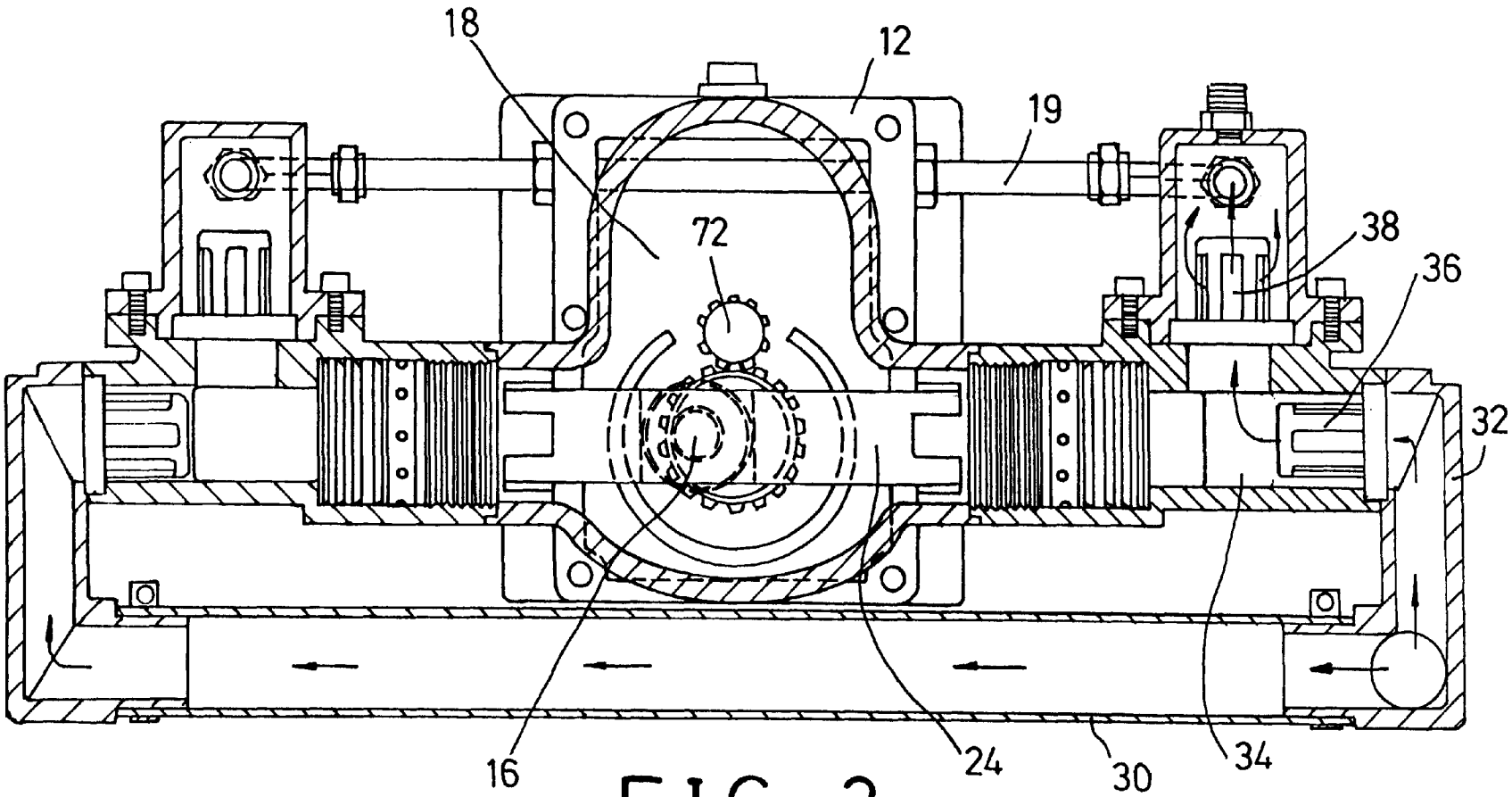
FIG. 3 is a cross sectional view taken along lines 3—3 of FIG. 1.

Referring to the drawings, and initially to FIGS. 1–3, a water pump in accordance with the present invention comprises a body 10 including a casing 12 secured on a base 11 of the body 10. A shaft 14 is rotatably received in a bore 13 of the casing 12 and includes a gear 15 provided on one end thereof and includes a cam or an eccentric pawl 16 extended from the other end thereof. The casing 12 includes a chamber 18 formed therein for receiving lubricating grease or oil and includes an orifice 17 formed therein for rotatably receiving a pinion 72 of a motor 70. The pinion 72 of the motor 70 is engaged with the gear 15 of the shaft 14 for rotating the shaft 14. A cover 20 is secured to the casing 12 and includes a lateral aperture 22 formed therein for slidably receiving a rod 24 which includes a depression 26 formed therein for receiving the pawl 16 of the shaft 14 and for allowing the rod 24 to be moved laterally in the aperture 22 of the cover 20 in a reciprocating action. A conduit 19 is engaged through the casing 12 and engaged in the chamber 18 of the casing 12 for receiving water therein and for cooling the lubricating grease received in the chamber 18 of the casing 12.

Two couplers 32 are coupled to the ends of a tube 30 and each includes a check valve 36 engaged therein and each includes an opening 34 formed therein for slidably receiving the ends of the rod 24. One of the couplers 32 includes an entrance 33 provided therein for receiving water from a housing 40 of a pressure relieving device and for allowing the water to flow into the other coupler 32 via the tube 30. Two receptacles 37 are secured between the couplers 32 and the ends of the conduit 19 respectively and each includes a check valve 38 secured therein. As shown in FIG. 3, the rod 24 that is driven by the motor 70 may be moved in the reciprocating action by the motor 70 to pump the water from the couplers 32 to the conduit 19 via the receptacles 37 and by the provision of the check valves 36, 38. A pressure gage and/or a flow meter 80 may further be provided and coupled to one of the receptacles 37 for detecting the water pressure and/or the water flow speed in the pipings.

Figure 4:
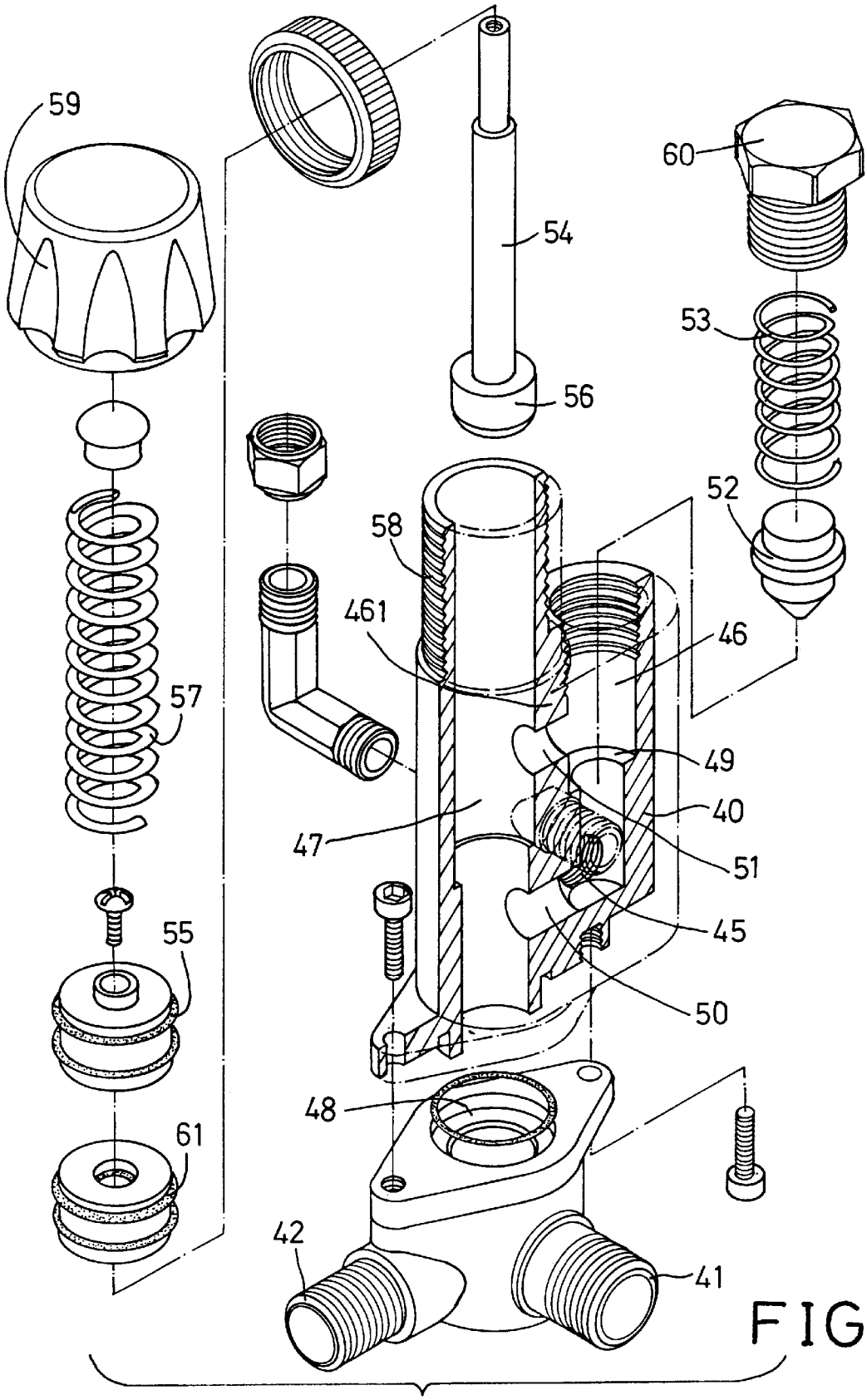
FIG. 4 is an exploded view of a pressure relieving device.

Referring next to FIGS. 4 and 5, and again to FIGS. 1 and 2, the housing 40 of the pressure relieving device includes a water inlet 41 coupled to a water reservoir for receiving the water therefrom, and includes an exit 42 coupled to the entrance 33 of the coupler 32 for supplying the water to the tube 30 and the conduit 19, and includes a water outlet 43 for output the water and includes a faucet or a control valve 44 (FIGS. 5–7) coupled to the water outlet 43 for controlling the water flowing through the water outlet 43, and includes a mouth 45 coupled to one of the receptacles 37 by a hose 39. The housing 40 includes two ducts 46, 47 formed therein and preferably formed in parallel to each other and separated from each other by a partition 461. A valve seat 48 is formed in the bottom of the duct 47, and another valve seat 49 is formed in the middle portion of the other duct 46. The partition 461 includes two passages 50, 51 formed therein for communicating the lower portions and the upper portions of the ducts 46, 47 respectively.

A plug 52 is slidably received in the upper portion of the duct 46 and biased to engage with the valve seat 49 by a spring 53. A cap 60 may be secured to the duct 46 for retaining the spring 52 and the plug 52 in the duct 46. A separator gasket 61 is secured in the middle portion of the duct 47 for separating the inner portion of the duct 47 into a lower interior portion 471 and an upper interior portion 472. A pole 54 is slidably engaged through the gasket 61 and includes a plug 56 secured to the bottom portion thereof for engaging with the valve seat 48 and includes an upper end secured to a slide gasket 55 for engaging with a spring 57. The duct 47 includes an outer thread 58 formed in the upper portion thereof for threading with a knob 59 which is engaged with the spring 57 and which may be used to adjust the spring biasing force of the spring 57 against the gasket 55 and the pole 54 by threading the knob 59 relative to the duct 47. The mouth 45 is communicating with the lower portion of the duct 46 and communicating with the lower interior portion 471 of the duct 47 via the passage 50. The water outlet 43 is communicating with the upper interior portion 472 of the duct 47 which is communicating with the upper portion of the duct 46 via the passage 51.

Figure 5:
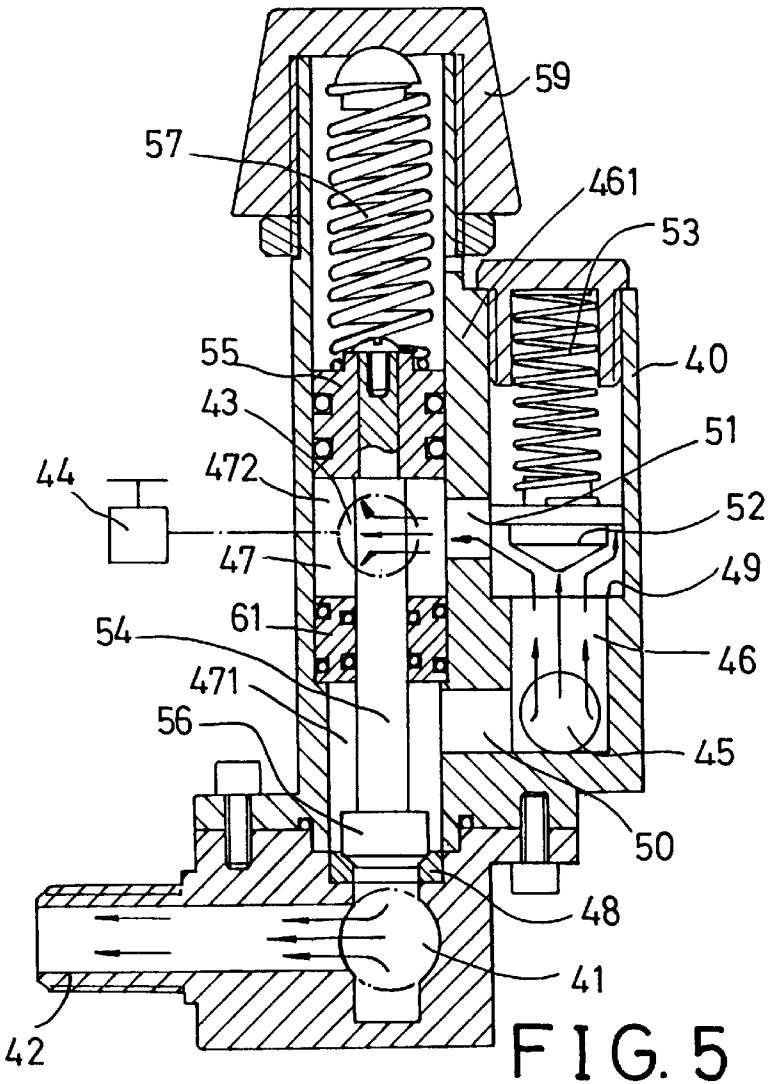
FIG. 5 is a cross sectional view of the pressure relieving device.

In operation, as shown in FIG. 5, when water is supplied into the water inlet 41 of the housing 40 and when the water outlet 43 is opened for allowing the water to flow out of the housing 40 via the water outlet 43, the pressure in the upper interior portion 472 of the duct 47 is relieved and the spring 57 may bias the plug 56 to engage with the valve seat 48. The water from the water inlet 41 may flow into the tube 30 and may be pumped, by the rod 24, to the conduit 19 and then pumped into the lower portion of the duct 46 via the mouth 45. The water flowing through the conduct 19 may be used for cooling the lubricating grease received in the chamber 18 of the casing 12. Because the valve seat 48 is blocked by the plug 56, the water from mouth 45 may thus force the plug 52 against the spring 53 and may thus flow out through the water outlet 43.

Figure 6:
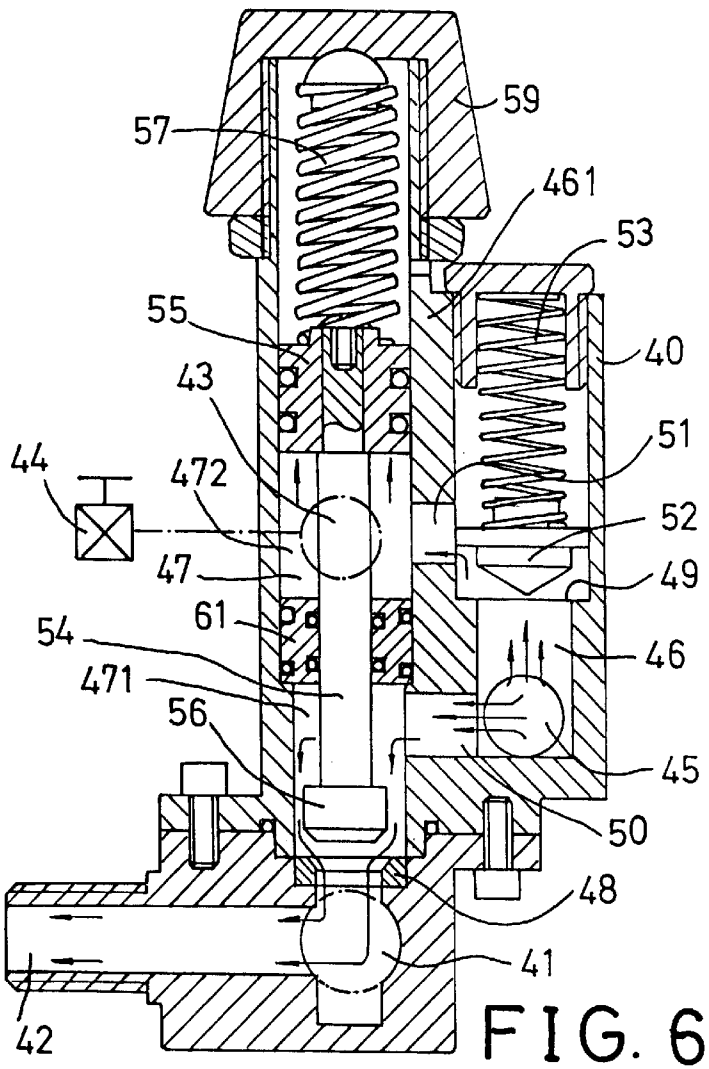
FIGS. 6 and 7 are cross sectional views showing the operation of the pressure relieving device.
Figure 7:
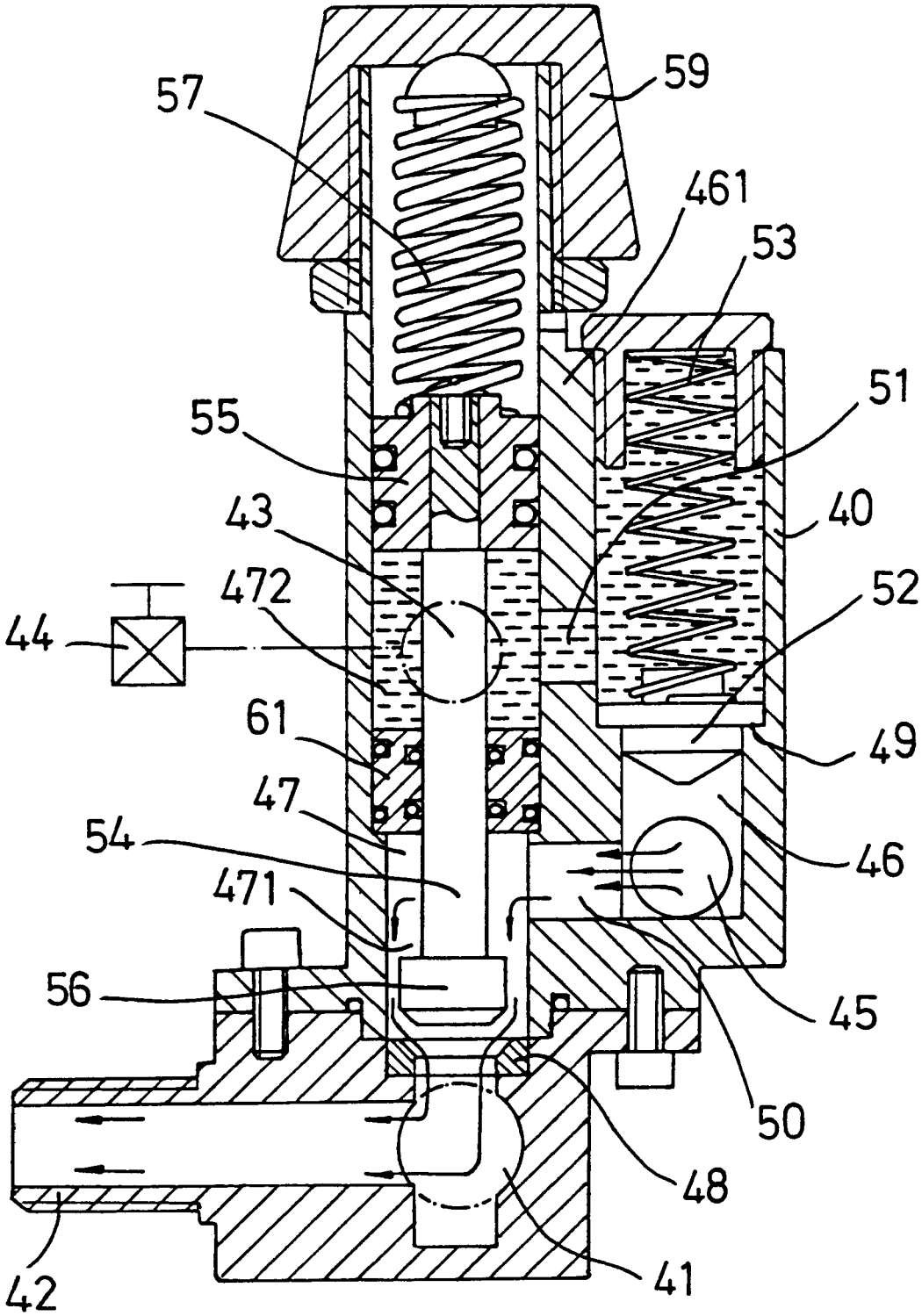

As shown in FIG. 6, when the water outlet 43 is closed by the valve 44, the water flowing into the upper interior portion 472 of the duct 47 may force the gasket 55 and thus the pole 54 upward against the spring 57 such that the plug 56 may be disengaged from the valve seat 48. As shown in FIG. 7, when the plug 56 is disengaged from the valve seat 48, the water from the mouth 45 may thus flow into the tube 30 via the exit 42 of the housing 40 and will no longer flow through the valve seat 49 and the passage 51 and the upper interior portion 472 of the duct 47. The spring 53 may thus bias the plug 52 to block the valve seat 49 again. The water may still be pumped into the conduit 19 by the motor 70 via the rod 24 and may circulate through the tube 30 via the mouth 45 of the housing 40, such that no water pressure will be built within the circulating water passage including the tube 30 and the conduit 19 and the water passage from the mouth 45 to the exit 42 of the housing 40. However, it is to be noted that, without the tube 30 and the conduit 19, the water pumped into the mouth 45 of the housing 40 from one of the receptacles 37 and the hose 39 may also circulate or bypass through the passage 50 and the lower interior portion 472 of the duct 47 and the exit 42 of the housing 40 and then may flow to the receptacle 37 and the hose 39 again, such that the water also will not be pressurized.

Accordingly, the water pump includes a pressure relieving device for relieving the pressure in the water passages when the water outlet is switched off and when the water pump is still actuated. The water pump includes a device for cooling the water pump.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as herein after claimed.

We claim:

1. A water pump comprising:

a pressure relieving device including a housing having a water inlet for receiving water from a water reservoir and including a water outlet for outward flow of the water, said housing including an exit and a mouth provided therein, a circulating water passage coupled between said exit and said mouth of said housing, means for pumping water from said exit of said housing to said mouth of said housing via said circulating water passage, and means for switching water to flow out of said water outlet when said water outlet is opened and to circulate through said exit and said circulating water passage when said water outlet is closed.

2. The water pump according to claim 1, wherein said circulating water passage includes a first coupler coupled to said exit of said housing, a first receptacle secured to said first coupler and coupled to said mouth of said housing.

3. The water pump according to claim 2 further comprising a second coupler, a second receptacle secured to said second coupler, a tube secured between said first coupler and said second coupler, and a conduit coupled between said first receptacle and said second receptacle.

4. The water pump according to claim 3, wherein said pumping means includes a rod slidably received between said first coupler and said second coupler, and means for moving said rod in a reciprocating action to pump the water in said first and said second couplers to said first and said second receptacles respectively.

5. The water pump according to claim 4, wherein said moving means includes a casing, a shaft rotatably secured in said casing and having an eccentric pawl extended therefrom for engaging with said rod and for moving said rod in said reciprocating action, and means for rotating said shaft and said eccentric pawl.

6. The water pump according to claim 5, wherein said rotating means includes a gear provided on said shaft, and a motor having a pinion engaged with said gear to drive said shaft.

7. The water pump according to claim 5, wherein said conduit extends through said casing for cooling a lubricating oil received in said casing.

8. The water pump according to claim 1, wherein said switching means includes a first duct and a second duct and a partition provided between said first duct and said second duct, said first duct includes a first portion communicating with said mouth and includes a second portion, said second duct includes a first interior portion communicating with said water inlet and includes a second interior portion communicating with said water outlet, said partition includes a first passage communicating said first portion of said first duct with said first interior portion of said second duct and includes a second passage communicating said second portion of said first duct with said second interior portion of said second duct, and means for blocking said first interior portion of said second duct when said water outlet is opened.

9. The water pump according to claim 8, wherein said switching means includes a separator gasket secured between said second and said first interior portions, a first valve seat provided between said water inlet and said first interior portion of said second duct, a first plug for engaging with said first valve seat, and means for biasing said first plug to engage with said first valve seat when said water outlet is closed.

10. The water pump according to claim 9, wherein said switching means includes a second valve seat provided between said first and said second portions of said first duct, a second plug for engaging with said second valve seat, and means for biasing said second plug to engage with said second valve seat when said water outlet is closed.

* * * * *